United States Patent [19]

Mitchell

[11] Patent Number: 4,543,772

[45] Date of Patent: Oct. 1, 1985

[54] HARNESS

[76] Inventor: Ronald W. Mitchell, 271 S.E. 5th Ter., Pompano Beach, Fla. 33060

[21] Appl. No.: 563,032

[22] Filed: Dec. 19, 1983

[51] Int. Cl.[4] ..... B68B 1/00

[52] U.S. Cl. ..... 54/2; 54/50

[58] Field of Search ..... 54/2, 43, 50, 51; 280/75, 76

[56] References Cited

U.S. PATENT DOCUMENTS

| | | | |
|---|---|---|---|
| 428,641 | 5/1890 | Singletary | 54/50 |
| 445,428 | 1/1891 | Foster | 54/2 |
| 473,624 | 4/1892 | Grammer | 54/50 |
| 904,696 | 11/1908 | Holder | 54/2 |

*Primary Examiner*—Robert P. Swiatek
*Attorney, Agent, or Firm*—Richard M. Saccocio

[57] ABSTRACT

Apparatus for attaching the shafts of a sulky to the harness of a horse. A cup on a tug strap is attached to the free end of the shaft. The tug strap is pivotally attached to the harness along the length of the tug strap. A shaft loop attached to the harness encircles the shaft. The remote end of the tug strap is attached to the shaft aft of the harness. The tug strap extends substantially parallel to and in alignment with the shaft forward of the harness and for a distance aft of the harness. Provision is provided for vertical and horizontal adjustment of the shaft relative to the horse.

5 Claims, 4 Drawing Figures

10
23
24
25
2
19
20
17
16
21
18
21
13
27
26
3
11
12

17
19
16
18
13
23
22
10
26
15
26
14
11
3
13
12

HARNESS

BACKGROUND OF THE INVENTION

1. Field of the Invention

This invention relates in general to the field of horse harnesses and in particular to a harness for sulky or harness racing and/or training.

2. Description of the Prior Art

Harness or sulky racing involves a race horse pulling a sulky or cart with the driver being seated within the cart. Typically, the cart is very lightweight—since it is designed for racing—and comprises a utilitarian frame having two wheels and a driver's seat attached thereto. Two shafts extend from or form part of the frame, creating an opening therebetween within which the race horse is positioned. A harness attaches the shafts of the sulky to the horse. The harness also serves the purpose of being the attachment point for the various reins and lines which the driver uses to control the horse. The present invention is not, however, concerned with the latter purpose. Hence, such lines and reins and their connections to the horse and harness need not be further explained or described herein.

Since the harness connects the horse to the sulky, the harness plays an extremely important role in lap times and the horse's ability to win a race. An efficient harness would transfer all of the energy expended by the horse into propelling the sulky. An inefficient harness wastes a portion of the horse's energy in transferring the same to the sulky and results in slower lap times. Also, an inefficient harness unduly restricts the horse's breathing and prevents the horse from achieving the speed he or she may be capable of attaining.

In my prior invention, now U.S. Pat. No. 4,414,790, issued Nov. 15, 1983, entitled "Harness and Attachment Method," I described a new and improved harness for horses, particularly race horses, pulling a sulky or a cart containing a driver. It is the first sulky racing harness which includes an elastic girth which allows a horse to breath deeply at a time when its lungs are demanding large quantities of air; namely, when the horse is engaged in the competition of racing. Previously, sulky harnesses utilized a nonstretchable leather girth around the horse's chest. My new harness has been an unqualified success, not only as far as allowing a horse to breath more easily, but in other respects as well. The harness limits fore and aft movement of the sulky relative to the horse allowing the sulky to track in better unison with the movement of the horse. In essence, it achieves more efficient energy transfer allowing lower lap times.

This is not to say, however, that there are no further improvements that can be made to sulky harnesses, nor that certain racehorses might not perform better with a different version of an elastic girth harness. In testing, it has been determined that certain racehorses do better with a harness that not only restricts fore and aft movement of the sulky but also on that allows relative angular motion in a vertical plane between the two shafts of a sulky (helpful when a horse is going around a curve and drops one shoulder) and does not transmit excess force to the harness causing the harness to shift in position on the horse and/or causing the horse to be restrictlve in its movements.

Accordingly, objects of the present invention are to provide a harness for a horse pulling a sulky which prevents fore and aft movement of the sulky relative to the motion of a horse, which provides a secure attachment of the sulky shafts to a harness, which allows relative angular movement in a vertical plane between the two sulky shafts, which allows relative horizontal motion and angularity between the horse and the sulky, and which does not transmit excessive force from the shafts of the sulky to the harness tending to shift the harness and/or restrict the movement of the horse. Although not specifically mentioned, there are, of course, other objects of the invention which are intended to be included within the scope hereof and which other objects will be obvious to one skilled in the art to which this invention pertains.

SUMMARY OF THE INVENTION

The above objects, as well as others, are achieved by the present invention which comprises apparatus for attaching the shafts of a sulky to a harness.

A unique thimble cup and tug strap is uniquely attached to the sulky shafts and the harness to provide an omnidirectional pivot between the sulky shafts and the harness on each side of the horse. A thimble cup is attached to a tug strap which attaches to the forward end of each shaft. The strap is parallel aligned with the sulky shaft up to the point where it is pin attached to the harness; this alignment continues a distance aft of the harness. The strap then is wrapped over or under the shaft and buckled to a tug tab which is attached to the outside surface of the shaft. A shaft loop encircling the shaft of the sulky is fitted to the harness at the pivotal point of the attachment of the tug strap to the harness. The point of attachment of the tug strap to the harness may be adjusted up or down on the harness to adjust for the different sizes of the horses using the invention.

Various other objects, advantages and features of the invention will become apparent to those skilled in the art from the following discussion taken in conjunction with the following drawings, in which:

DESCRIPTION OF THE PREFERRED EMBODIMENTS

Figure 1:
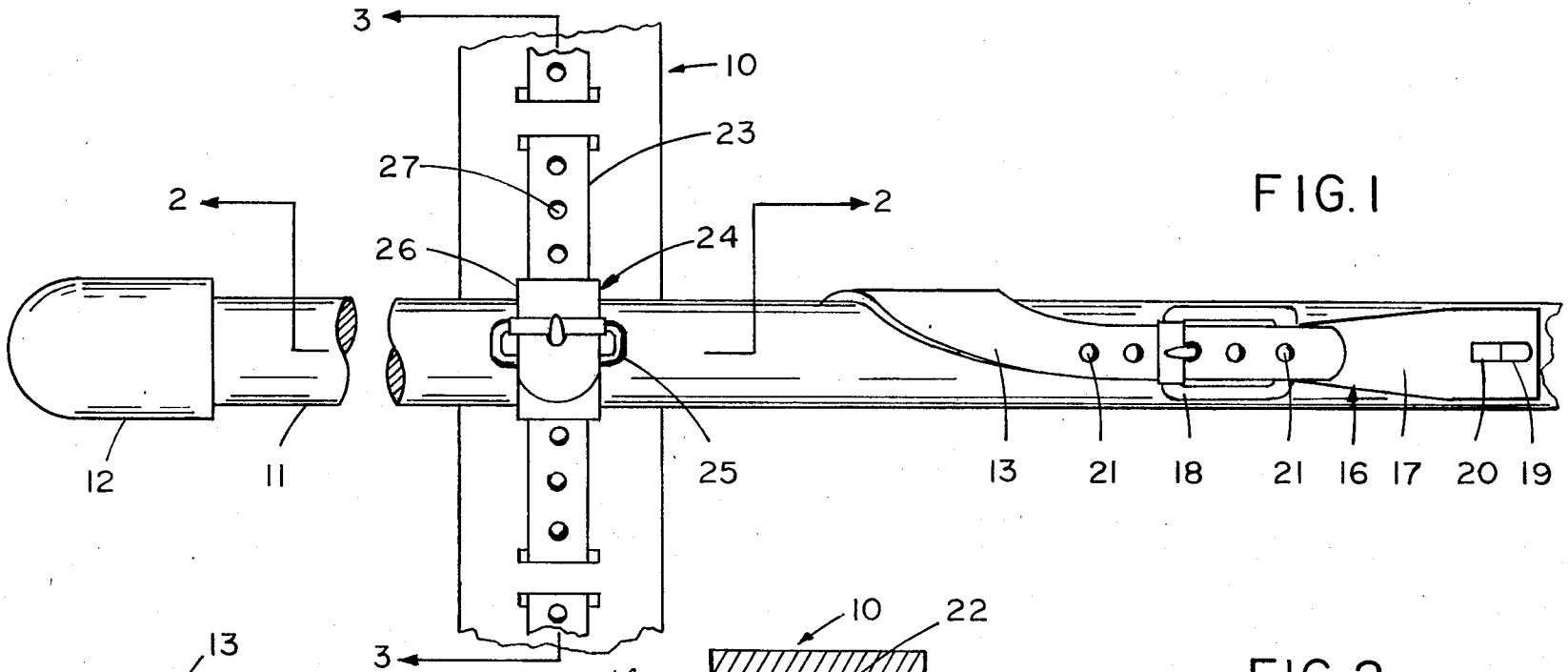
FIG. 1 is a side elevational view of the inventive thimble cup and tug strap showing the attachment of a sulky shaft to one side of a harness.
Figure 2:
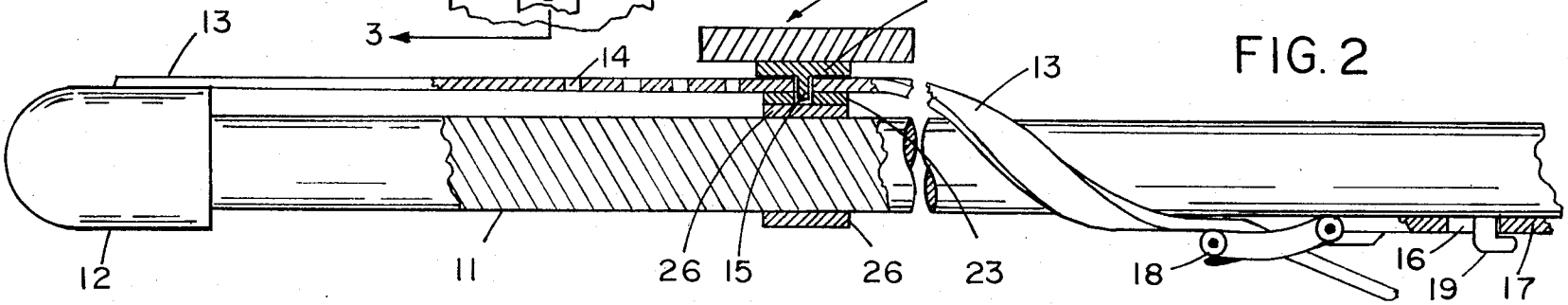
FIG. 2 is a top elevational view, partly in cross section, as taken along the line 2—2 of FIG. 1.

Referring now to the drawings, particularly to FIGS. 1 and 2, there is depicted therein the inventive thimble cup, tug strap, and tug and tab attached to a harness and one shaft of a sulky. Harness 10 may, for example, comprise a harness similar to my inventive harness disclosed in U.S. Pat. No. 4,414,790, issued Nov. 15, 1983, and entitled "Harness and Attachment Method." Harness 10 encircles and is attached to the chest portion of a horse in a conventional manner which is not shown. The head of the horse would be to the left of the drawings and the horse would be facing in a direction to the left. The cart portion of the sulky (not shown) would be to the right of the drawings and behind the horse. Shaft 11 would, therefore, comprise the left shaft of the sulky. The right shaft is not shown for purposes of clarity; the inventive tug strap and attachment to the right shaft would, however, be the same as that shown for the left shaft 11.

A standard thimble cup 12, as is well known in the art, is attached to tug strap 13 such as by sewing. Tug strap 13 comprises an elongated strap which may be made from leather, nylon or other material commonly used with harness straps. Tug strap 13 includes a plurality of holes 14 through the thickness thereof and spaced along the length thereof. The spacing between holes 14 is not critical to the invention but should be such that they enable the tip of the shaft 11 to be appropriately located forward of harness 10 and allow relatively fine adjustments to the left and right thereof. One of the holes 14 in tug strap 13 is fitted to a pin 15 securely attached to harness 10. As can be seen from the drawings, tug strap 13 is fitted between shaft 11 and the horse and is axially aligned with shaft 11 from the forward tip of shaft 11 to a distance aft of harness 10.

A tug tab 16 comprising a short strap 17 having a buckle 18 attached thereto is connected to an ell-shaped hook 19 protruding from shaft 11. An elongated slot 20 in strap 17 allows the connection to hook 19. The length of slot 20 is approximately half of the length of the spacing between holes 21 in the end of tug strap 13. Tug tab strap 16 may be wider at the end near slot 20 as compared to the end near buckle 18 to provide additional strength in the vacinity of slot 20.

Figure 3:
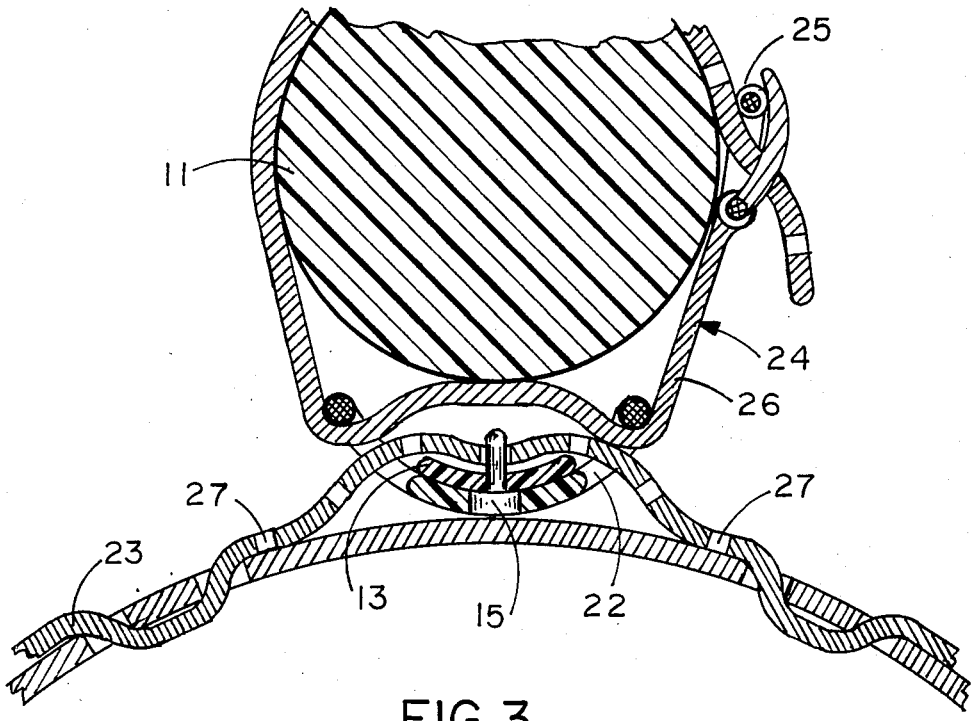
FIG. 3 is a cross-sectional view of the harness of FIG. 1 taken along the line 3—3 of FIG. 1; and, FIG. 4 is an isometric view showing the attachment of the tug strap to the harness and also showing a shaft loop.
Figure 4:
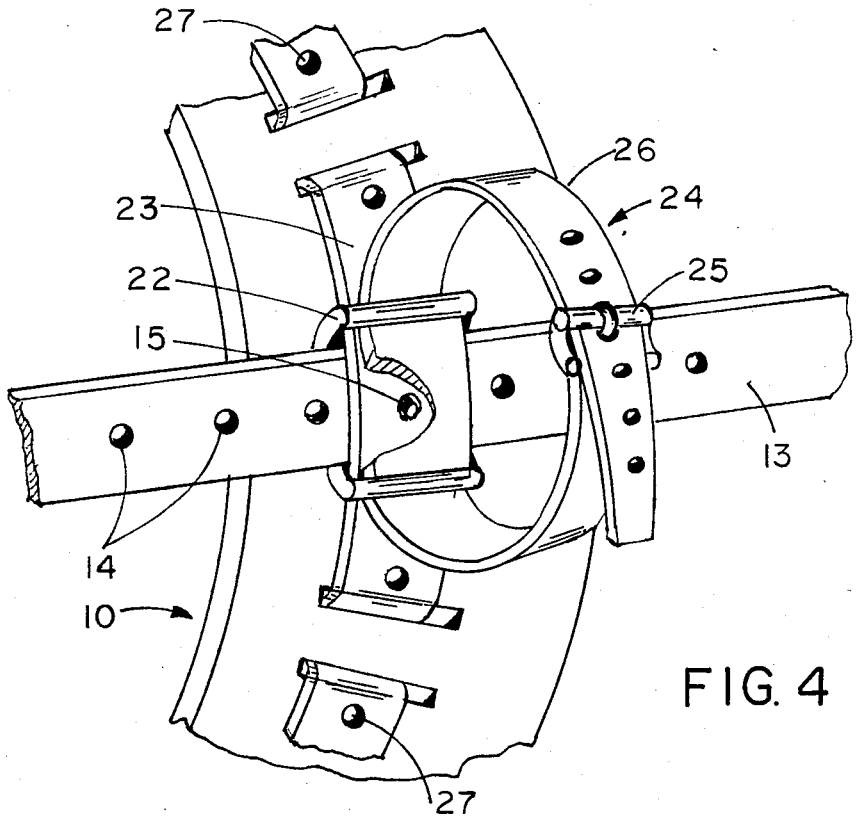

Pin 15 may comprise the pin protruding from the center of a conway-type of buckle 22 which may be attached to harness 10 by a strap 23 as disclosed in my previously referenced U.S. Pat. No. 4,414,790, which method of attachment is incorporated herein by reference. Tug strap 13 is fitted between the concave surface of buckle 22 and girth strap 23 and at a right angle to girth strap 23. The secured attachment of girth strap 23 and the tightening of the same when harness 10 is securely fitted to a horse serve to firmly lock tug strap 13 in place to harness 10 and prevent tug strap 13 from disengaging from pin 15. FIGS. 3 and 4 further help to clarify this aspect.

A shaft loop 24 comprising a free length of strap 26 having a buckle 25 attached to one end thereof is also fitted to and connected to conway buckle 22. Shaft loop 24 serves to further lock tug straps 13 in place on pin 15. Shaft loop 24, however, primarily serves to encompass and further locate shaft 11 to harness 10. Shaft loop 24 may or may not be tightly wrapped around shaft 11. That is, shaft 11 may float in shaft loop 24 without detracting from the attachment of shaft 11 to harness 10 as provided by the present invention.

In attaching the sulky to the harness 10, the following procedure may be used. Girth strap 23 is sufficiently loosened from harness 10 to lift it off from pin 15 of buckle 22. Tug strap 13 is selected to fit over pin 15 so that a desired distance exists between the end of thimble cup 12 and harness 10 which in turn fixes the horizontal location of the sulky relative to the horse along the longitudinal axis of the horse and sulky. Tug strap 13 is pressed over pin 15, then girth strap 23 is pressed over pin 15. The shaft loop strap 26 is threaded through conway buckle 22 and may be formed into a loop 24 of larger diameter than shaft 11. Harness 10 is then attached to and securely fitted to a horse. If the vertical location of shaft loop 24 is too low or too high, an adjustment is made by repositioning buckle 22 to a different hole 27 along the length of girth strap 23. The same procedure is, of course, utilized on both sides of the harness 10.

The sulky is then moved into position and shafts 11 are fitted through loops 24. Thimble cups 12 are placed over the ends of shafts 11. The sulky is moved forward relative to the horse so as to remove all of the slack from tug straps 13 (forward of harness 10). Then, working on one side of the horse, the tug lug strap 17 is fitted over hook 19. The free end of tug strap 13 is draped either over or under shaft 11 so as to bring strap 13 from the inside of shaft 11 to the outside of shaft 11. The free end of strap 13 is then threaded through buckle 18 and pulled with sufficient force to take all the slack out of tug strap 13 and tightly fit shaft 11 between thimble cup 12 and hook 19. The pin in buckle 18 is then fitted through one of the holes 21 in the end of tug strap 13. The half length size of slot 20 assures that one of the holes 21 may be properly selected to make certain tug strap 13 is taut. This procedure is then accomplished on the other side of the horse. The sulky is now properly fitted to the harness and the remaining straps (not shown) such as the overcheck strap, crupper strap, martingale straps, hip strap, etc., may be fitted and adjusted to complete the hookup of horse and sulky.

If desired, the shaft loop straps 26 may now be tightened to firmly fit around shafts 11; but as previously mentioned, the invention will function equally as well whether the shaft 11 floats in loop 24 or fits snugly therein.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. In a harness adapted to be fitted to a horse and the shafts of a sulky, said harness including a saddle portion extending around the sides and the top of the horse and a girth portion attached to said saddle portion extending around the sides and chest portion of the horse, the improvement comprising apparatus for attaching a shaft of said sulky to each side of said harness comprising a cup member adapted to be fitted to the forward end of said shaft, an elongated first strap attached to said cup member, means for pivotally attaching said first strap along its length to said saddle portion, means for attaching the remote end of said first strap to the shaft of the sulky aft of said harness, and a shaft loop for further attaching said shaft to said harness comprising a second strap attached to said harness and adapted to encircle said shaft, whereby said shaft and said first strap are substantially aligned along their longitudinal axis and whereby said first strap is aligned substantially transversely with said second strap.

2. The apparatus of claim 1, wherein said pivotally attaching means comprises a pin secured to said harness and extending a short distance therefrom and said elongated first strap includes one or more holes therethrough along the length thereof, said pin fitting into one of said one or more holes.

3. The apparatus of claim 2, wherein said pin comprises the pin of a conway type of buckle with said conway type of buckle being attached to said harness by a third strap attached to said harness, said conway type buckle being adjustably positioned along the length of said third strap.

4. The apparatus of claim 3, wherein said first strap is interposed between the inner concave surface of said conway type of buckle and said third strap.

5. The apparatus of claim 1, wherein said means for attaching the remote end of said first strap to the shaft of the sulky comprises a hook attached to said shaft, a third strap attached to said hook, a buckle at the end of said third strap between said hook and said harness, said first strap being attached to said third strap by said buckle.

* * * * *